US007897888B2

(12) United States Patent
Dimig

(10) Patent No.: US 7,897,888 B2
(45) Date of Patent: Mar. 1, 2011

(54) KEY FOB DEVICE AND METHOD

(75) Inventor: Steven J. Dimig, Plymouth, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 11/396,263

(22) Filed: Mar. 30, 2006

(65) Prior Publication Data

US 2007/0227866 A1 Oct. 4, 2007

(51) Int. Cl.
*H01H 13/06* (2006.01)

(52) U.S. Cl. ..... 200/302.2; 200/5 A

(58) Field of Classification Search ..... 200/302.2
See application file for complete search history.

(56) References Cited

U.S. PATENT DOCUMENTS

| | | | | |
|---|---|---|---|---|
| 5,893,959 | A | 4/1999 | Muellich | |
| 6,180,896 | B1 | 1/2001 | Naritomi | |
| 6,462,291 | B1 | 10/2002 | Sachs | |
| 6,571,457 | B2 | 6/2003 | Naritomi | |
| 6,573,463 | B2 | 6/2003 | Ono | |
| 6,589,229 | B1 | 7/2003 | Connelly et al. | |
| 6,770,324 | B2 | 8/2004 | Hooker | |
| 6,770,824 | B1 * | 8/2004 | Faucher | 200/5 A |
| 6,862,148 | B2 | 3/2005 | Kakinoki et al. | |
| 6,980,095 | B2 | 12/2005 | Wright et al. | |
| 7,034,238 | B2 * | 4/2006 | Uleski et al. | 200/500 |
| 7,041,924 | B2 * | 5/2006 | Jeschke et al. | 200/302.2 |
| 7,046,136 | B2 | 5/2006 | Sugimoto et al. | |
| 7,050,292 | B2 | 5/2006 | Shimura et al. | |
| 7,166,812 | B2 * | 1/2007 | White et al. | 200/341 |
| 7,499,283 | B2 | 3/2009 | De Los Santos et al. | |
| 2001/0037933 | A1 | 11/2001 | Hunter et al. | |
| 2004/0200709 | A1 * | 10/2004 | Sugimoto et al. | 200/302.2 |
| 2005/0199019 | A1 | 9/2005 | Marcelle et al. | |
| 2005/0205402 | A1 | 9/2005 | Wright et al. | |
| 2006/0023442 | A1 | 2/2006 | De Los Santos et al. | |
| 2007/0270013 | A1 | 11/2007 | Clark | |
| 2008/0073186 | A1 | 3/2008 | Kenmochi | |

OTHER PUBLICATIONS

PCT International Search Report for PCT/US2007/007806 dated Nov. 14, 2008, 2 pages.
PCT Written Opinion of the International Searching Authority for PCT/US2007/007806 dated Nov. 14, 2008, 8 pages.
PCT International Search Report for Int'l Appl. No. PCT/US2008/008860 dated Jan. 14, 2009, 3 pages.
PCT Written Opinion of the Int'l Searching Authority for Int'l Appl. No. PCT/US2008/008860 dated Jan. 14, 2009, 7 pages.

* cited by examiner

*Primary Examiner* — Renee Luebke
*Assistant Examiner* — Lheiren Mae A Caroc
(74) *Attorney, Agent, or Firm* — Michael Best & Friedrich LLP

(57) ABSTRACT

A device and method for a key fob. The key fob device can include a housing, a lid defining one or more apertures, a circuit board including one or more switches, and a flexible film coupled to the housing and/or the lid. The flexible film can include one or more contact surfaces and stylized graphics.

21 Claims, 8 Drawing Sheets

KEY FOB DEVICE AND METHOD

BACKGROUND OF THE INVENTION

Conventional key fobs generally include a two-piece housing, molded silicone rubber buttons, a printed circuit board (PCB), an antenna, and a battery clip coupled to one of the two pieces of the housing. To reduce costs, the pieces of the housing are generally made from black plastic. A single piece of molded silicone rubber (substantially the same size as the housing) generally defines each of the buttons and a lip around the rubber piece to provide a seal between the two pieces of the housing. Carbon pieces are generally attached to the undersides of the buttons. The PCB is positioned beneath the silicon rubber buttons and includes electrical traces. When a button is depressed, the carbon piece on the underside of the button closes the traces on the PCB and activates a desired feature on a vehicle.

For a family of conventional key fobs, an entire family of tooling is required to accommodate varying numbers of buttons, patterns, textures, and other styling. Due to the cost of the additional tooling, molding a family of key fobs with different features and styling is difficult and expensive.

SUMMARY OF THE INVENTION

A need exists for the ability to add color and/or various patterns and textures to key fobs while incurring minimal additional costs. A need also exists for creating a family of key fobs with varying numbers of buttons depending on vehicle make and/or accessory options.

In one embodiment, the invention provides a key fob including a housing, a lid defining one or more apertures, a circuit board including one or more switches positioned within the apertures, and a flexible film coupled to the housing and/or the lid. The flexible film can include one or more contact surfaces. The contact surfaces can flex when a force is applied in order to actuate the switches. The flexible film can include stylized graphics for a particular make of vehicle.

In another embodiment, the invention provides a method of producing a key fob. The method can include printing stylized graphics on a flexible film, positioning a circuit board in a housing, coupling the flexible film to a lid, positioning the lid in the housing, and sealing the flexible film to the housing.

Other aspects of the invention will become apparent by consideration of the detailed description and accompanying drawings.

DETAILED DESCRIPTION OF THE INVENTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
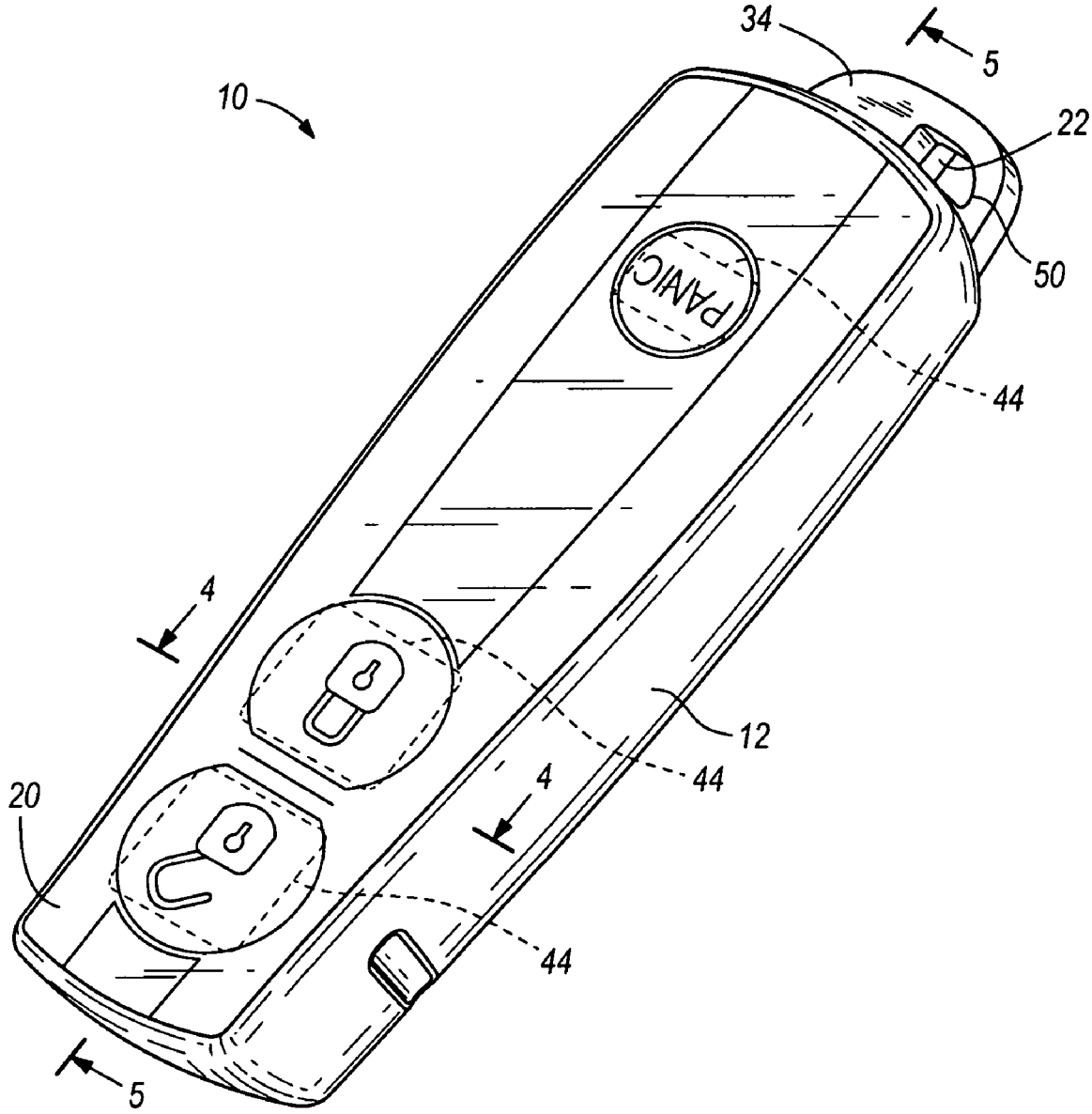
FIG. 1 is a perspective view of a key fob according to one embodiment of the invention.
Figure 2:
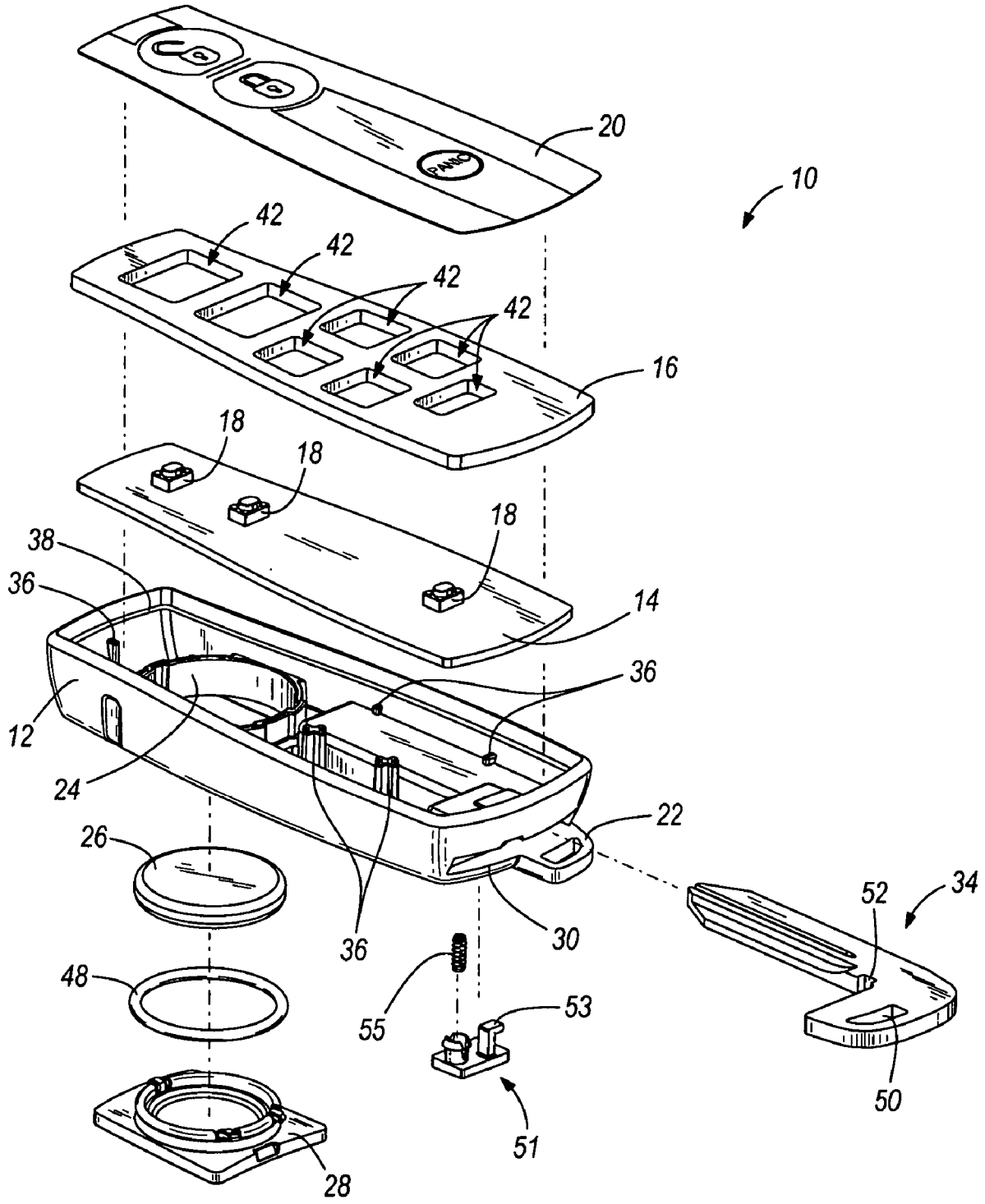
FIG. 2 is an exploded perspective view of the key fob of FIG. 1.

FIGS. 1-6 illustrate a key fob 10 according to one embodiment of the invention. As shown in FIG. 2, the key fob 10 can include a housing 12, a printed circuit board (PCB) 14, a lid 16, one or more switches 18, and a flexible film 20. The housing 12 can be generally tub-shaped and can be constructed from plastic. In other embodiments, the housing 12 can be constructed from a composite material, a metal, or another suitable material. The housing 12 can include a valet hook 22 for hanging up the key fob 10. The housing 12 can include a cylindrical recess 24 that can receive a battery 26 and a battery access door 28. The housing 12 can include an elongated aperture 30 that can receive a mechanical key blade 34. The housing 12 can include standoffs 36 on an interior portion in order to provide surfaces to support the PCB 14. The standoffs 36 can help ensure that the PCB 14 is positioned correctly with respect to other components within the key fob 10. Above or at substantially the same vertical position of the standoffs 36, a shelf 38 can be defined around the perimeter of the housing 12. The shelf 38 can provide a surface to support the lid 16 above the PCB 14.

The PCB 14 can be shaped according to the shape of the interior portion of the housing 12. The PCB 14 can include electrical components that allow the key fob 10 to control various functions of a vehicle. These functions can include, but are not limited to, remotely actuating door locks, a trunk lock, lights, and an ignition. The PCB 14 can include an antenna (not shown), a controller (not shown), and one or more switches 18. The PCB 14 can receive power from the battery 26. The PCB 14 can be positioned between the standoffs 36 and the lid 16.

Figure 4A:
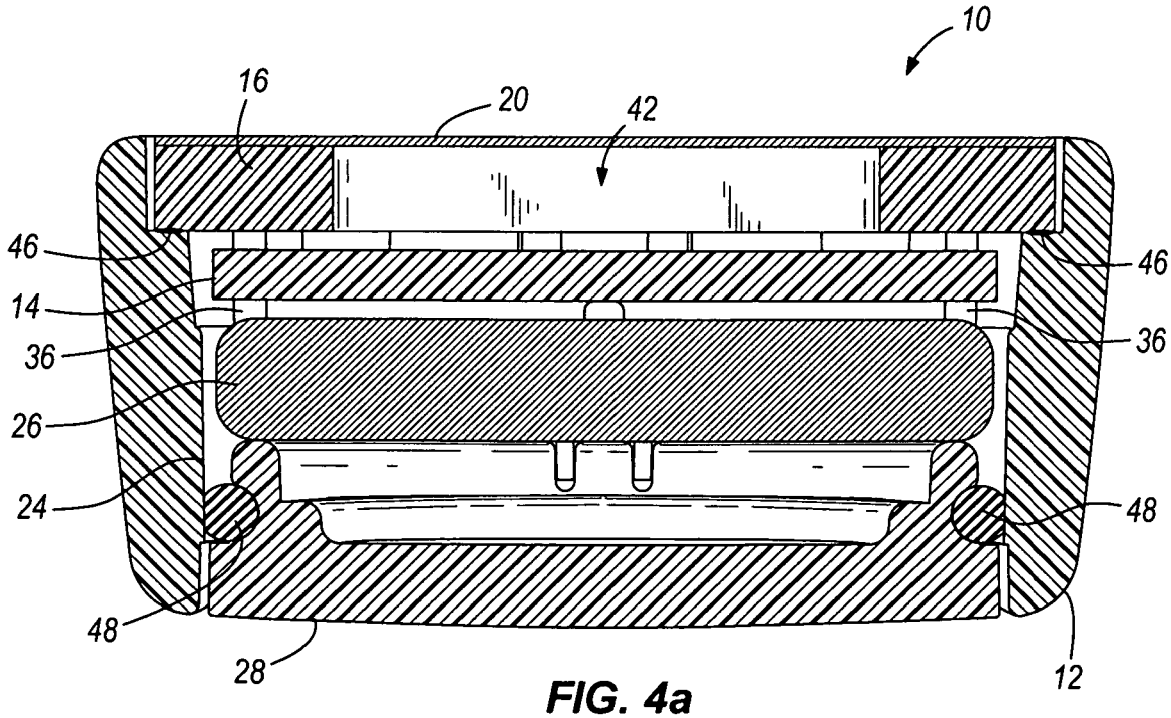
FIG. 4*a* is a cross-sectional view of the key fob taken along line 4-4 of FIG. 1.
Figure 4B:
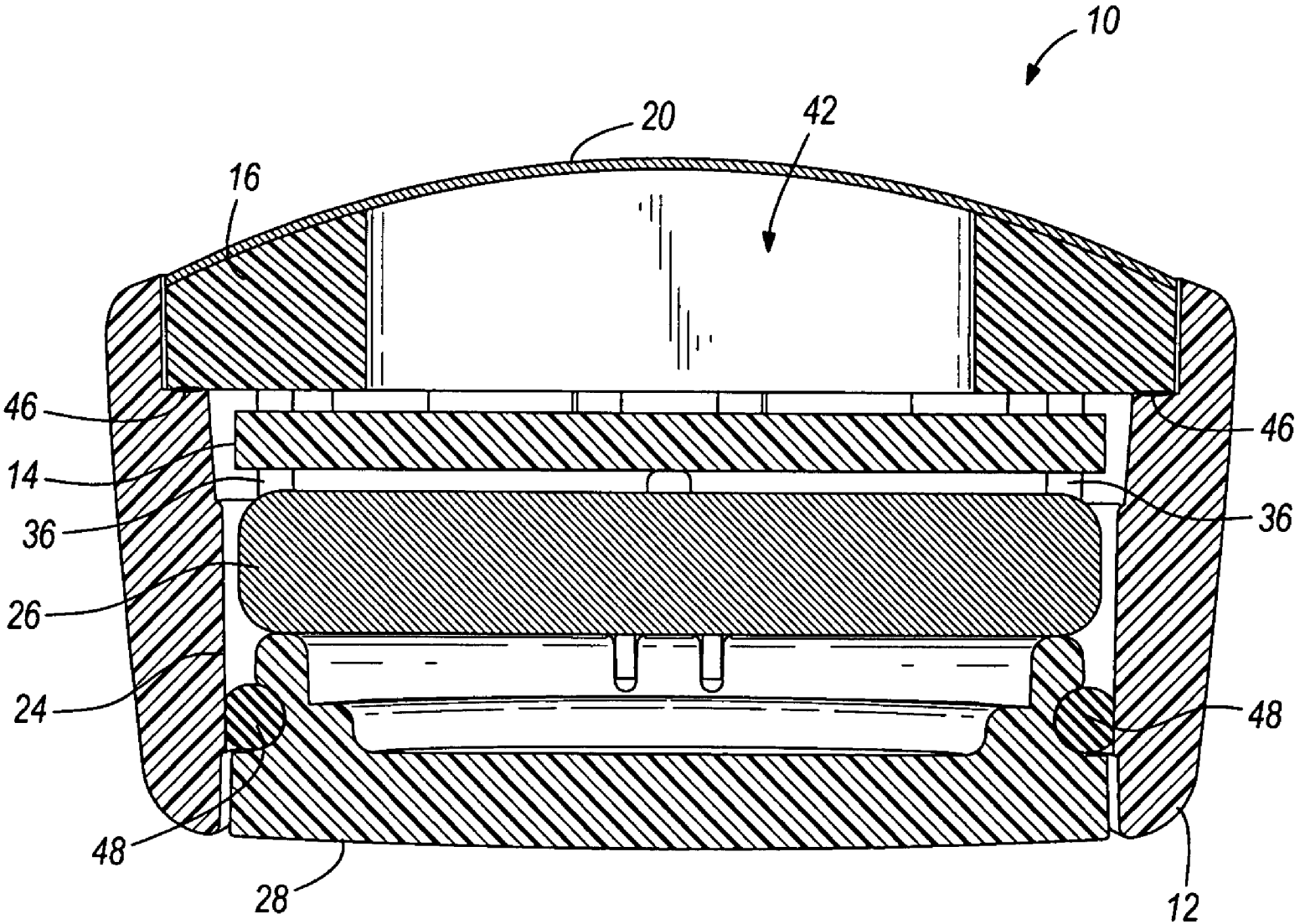
FIG. 4*b* is a cross-sectional view of an alternative embodiment of the key fob taken along line 4-4 of FIG. 1.
Figure 5:
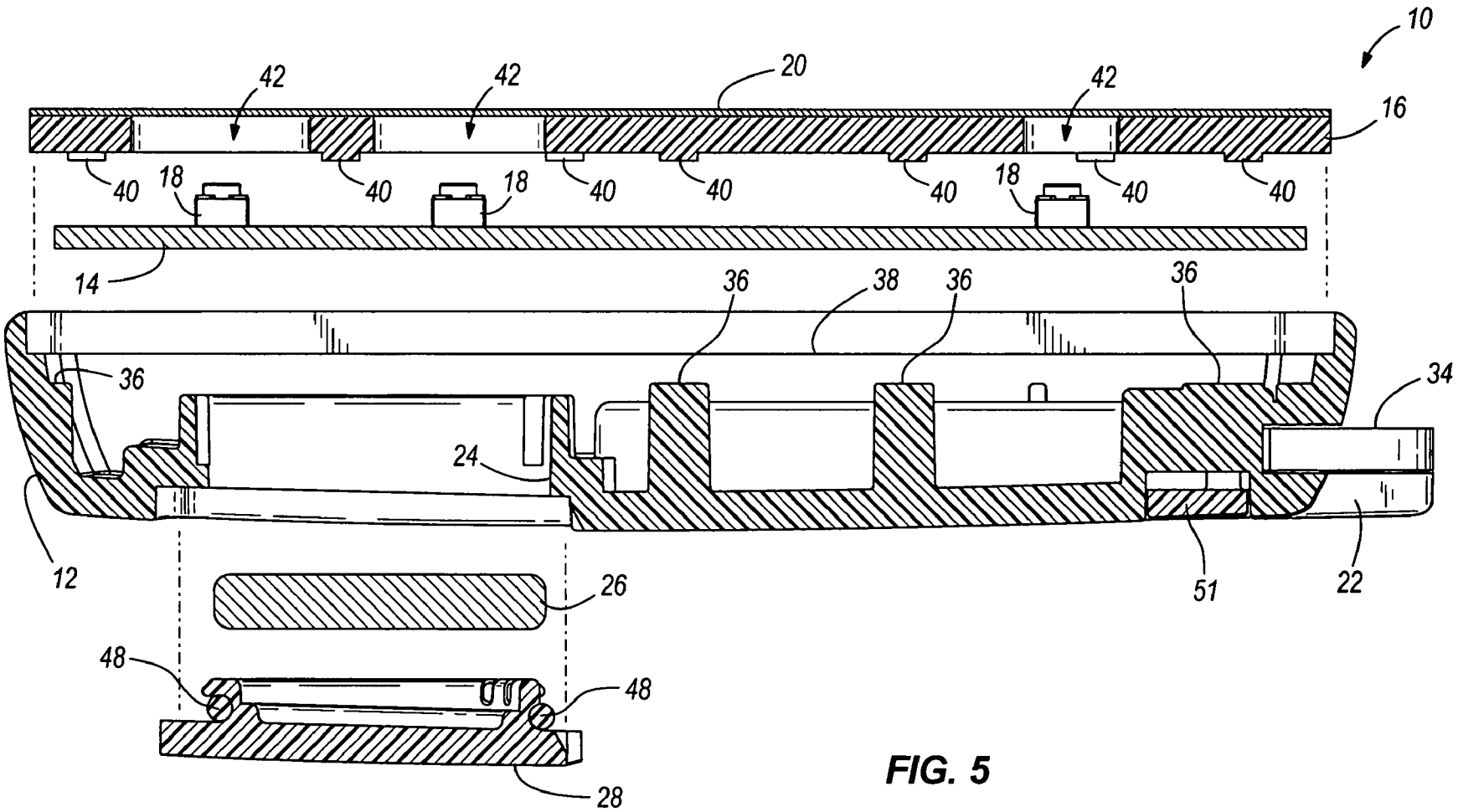
FIG. 5 is an exploded cross-sectional view taken along line 5-5 of FIG. 1

As shown in FIG. 5, the lid 16 can include one or more standoffs 40 and one or more apertures 42 defined in a sheet of a plastic material. In one embodiment, the lid 16 can be injection molded in order to define the standoffs 40 and the apertures 42. In other embodiments, the lid 16 can be constructed of metal or another suitable material. The standoffs 40 can contact portions of the PCB 14 away from the electrical components and/or the switches 18. When the lid 16 is joined to the housing 12, the standoffs 40 can help hold the PCB 14 in place by pressing the PCB 14 against the standoffs 36 of the housing 12 (as shown in FIGS. 4 and 5). The lid 16 can be positioned above the PCB 14 to allow the switches 18 to be actuated through the apertures 42.

In some embodiments, the switches 18 can be tact switches. For their size, tact switches typically require a relatively-high force to actuate the switch. Tact switches also typically have a relatively short stroke (e.g., 0.25 mm) and generate an audible click when actuated. The number of switches 18 included in the fob 10 can be based on each application, such as each make in a family of vehicles. Rather than tact switches, other types of switches or actuators can be used. For example, an electrically-conductive material can be positioned under a contact surface of the flexible film 20 in order to contact two conductive traces on the PCB 14 to complete a circuit. In some embodiments, the switches 18 can be soldered onto the PCB 14 and can be positioned within the apertures 42, so that the top of the switch 18 is at or slightly below a top surface of the lid 16. The switches 18 can be actuated through each one of the corresponding apertures 42 in the lid 16.

Figure 8:
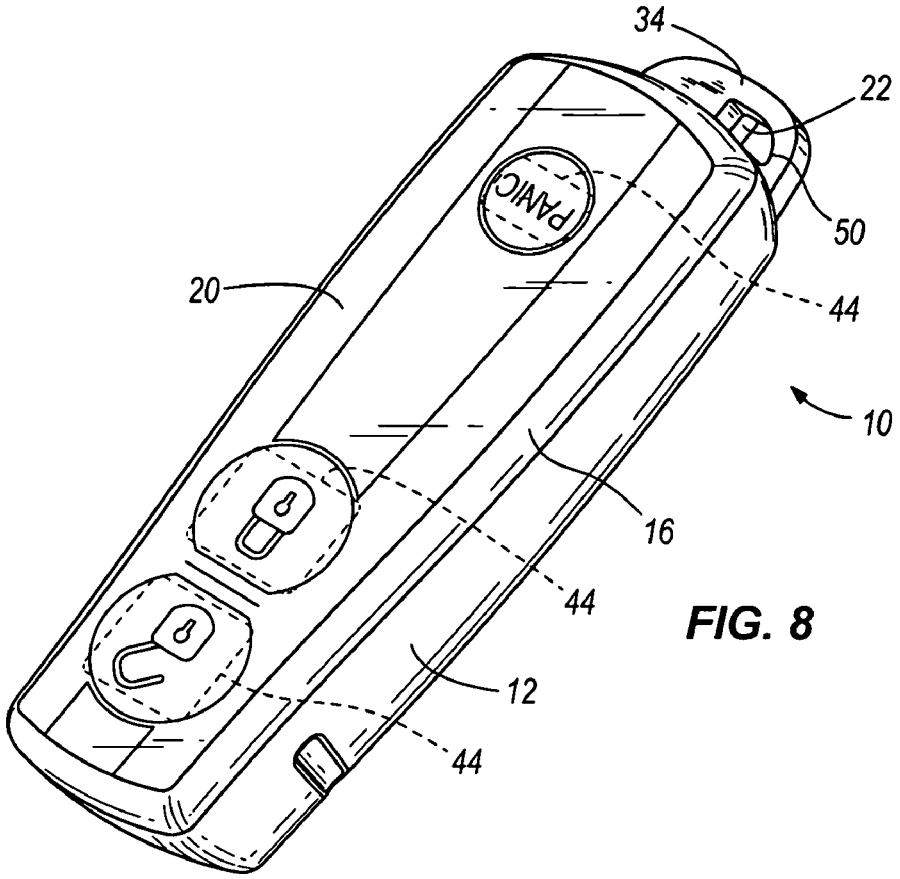
FIG. 8 is a perspective view of a key fob according to another embodiment of the invention.
Figure 9:
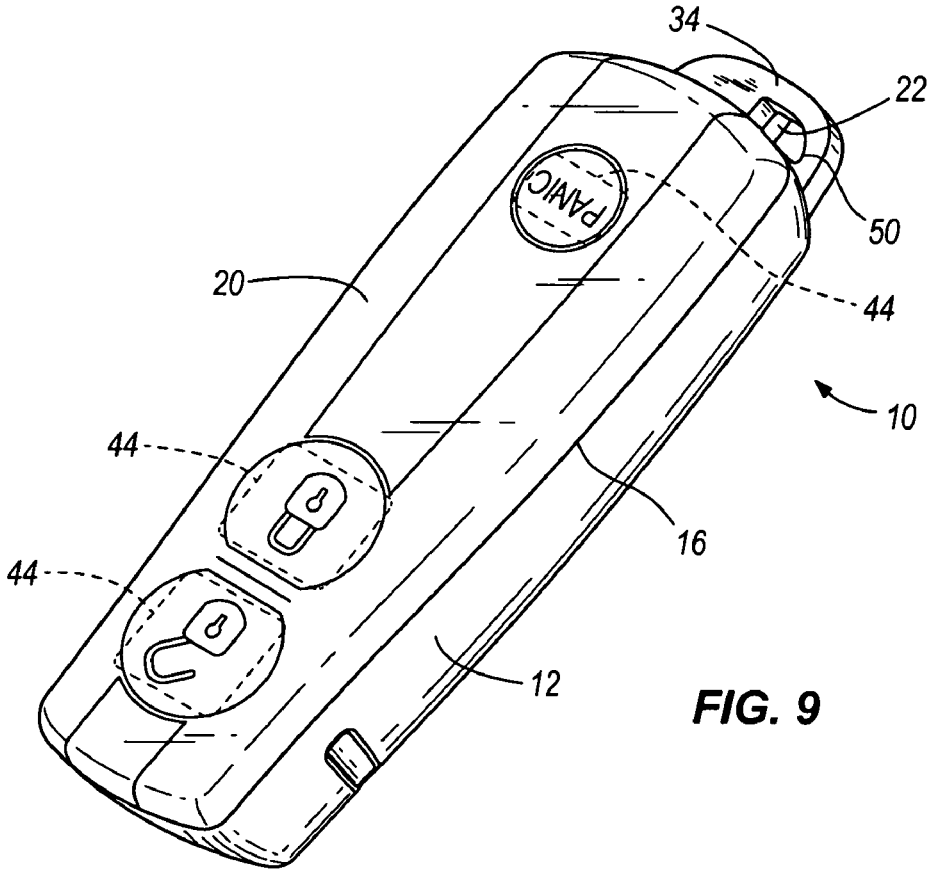
FIG. 9 is a perspective view of a key fob according to yet another embodiment of the invention.

As shown in FIG. 2, the flexible film 20 can include a relatively-thin piece of plastic having a perimeter substantially equal to the perimeter of the lid 16 and the housing 12. In some embodiments, the lid 16 can include a portion extending above the housing as shown in FIGS. 8 and 9. In the embodiment shown in FIG. 8, the flexible film 20 can have a smaller perimeter than the perimeter of the lid 16. In the embodiment shown in FIG. 9, the flexible film 20 can be thermoformed such that the shape of the flexible film 20 substantially matches the contour of the lid 16. The flexible film 20 can define contact surfaces 44 above one or more of the apertures 42. In some embodiments, the flexible film 20 is coupled to the lid 16 by an adhesive. In other embodiments, the flexible film 20 can be coupled to the lid 16 by at least one of injection molding the lid 16 onto the flexible film 20, laser welding, or sonic welding. In still other embodiments, the flexible film 20 can be coupled to the lid 16 by snap fitting the flexible film 20 to the lid 16.

As shown in FIG. 1, as an example only, the key fob 10 can include three contact surfaces 44 corresponding to three vehicle functions. As shown in FIG. 2, the key fob 10 can include three switches 18 corresponding to the three contact surfaces 44. However, the number of switches 18 and contact surfaces 44 can vary depending on remotely actuated functions required for a particular vehicle.

Figure 3:
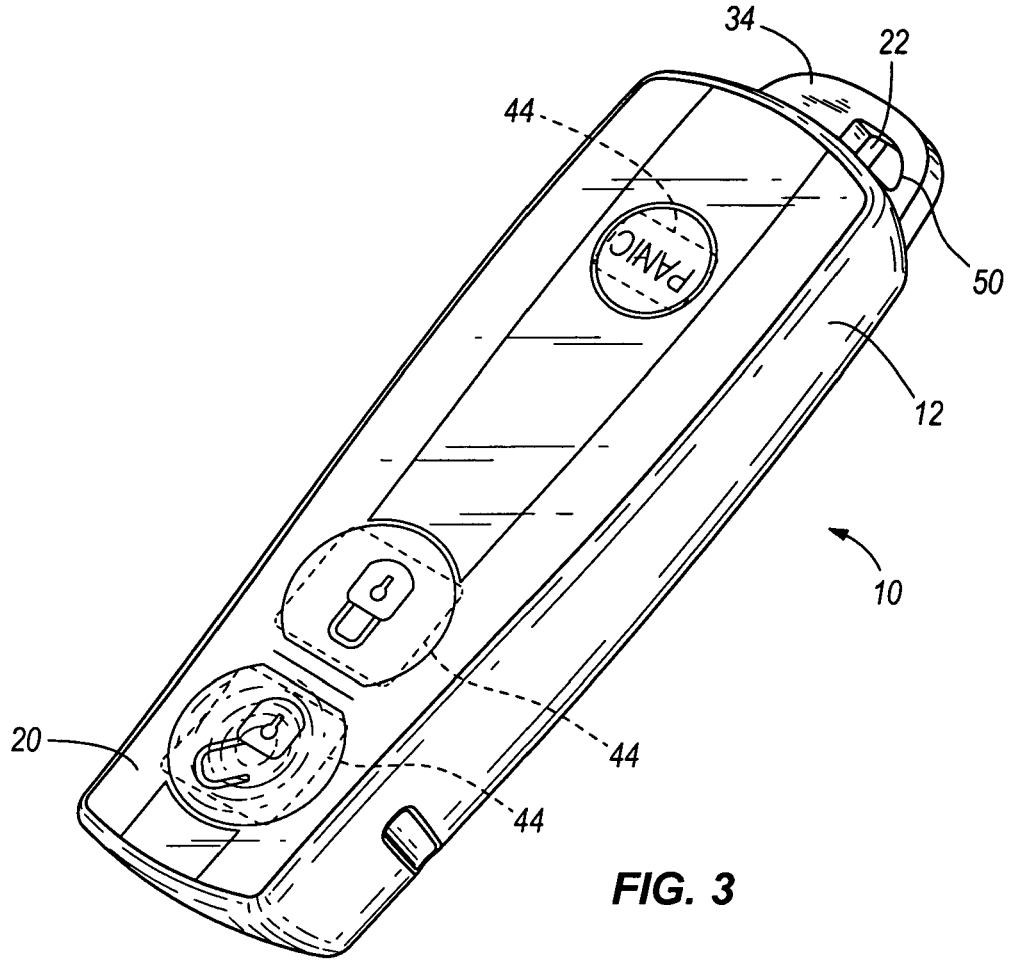
FIG. 3 is a perspective view of the key fob of FIG. 1, illustrating a flexible film being depressed to actuate a switch.

As shown in FIG. 3, a switch 18 can be actuated through one of the apertures 42 by pressing a contact surface 44 of the flexible film 20, which can flex enough to actuate the switch 18. Due to the positioning of the switch 18 and its short stroke, the flexible film 20 only needs to flex a minimal distance to actuate the switch 18. The life of the flexible film 20 can be extended by using switches with a short stroke that only requires the flexible film 20 to flex a minimal distance. The audible and tactile click of the switch 18 can alert the operator that the switch 18 has been depressed.

The flexible film 20 can be screen printed on one or both sides in order to add stylized graphics, contact surfaces, textures, etc. In some embodiments, each individual flexible film 20 is die-cut to shape from a sheet of flexible film. In some embodiments, the flexible film 20 can be constructed from a clear polycarbonate resin. In some embodiments, the flexible film 20 can be relatively thin (e.g., approximately 0.4-0.5 mm thick). Screen printing can be used to provide high resolution printing in a single or multiple layers at a relatively low cost. Other embodiments can use other methods of customizing the flexible film 20, such as laser printing, colored films, decals, etc.

In addition to printing graphics and contact surfaces 44 on the flexible film 20, it is possible to print a rail of thicker ink around the contact surfaces 44 to provide a tactile boundary for each contact surface 44. Additionally, more plastic or polydoming material can be poured into the rail of thicker ink to fill in and/or dome the contact surface 44. When the plastic cures, a domed surface can be formed to correspond to one or more of the switches 18. In some embodiments, the flexible film 20 can have raised contact surfaces 44 created by thermoforming the flexible film 20. Thermoforming can include heating the flexible film 20 and applying a vacuum between the flexible film 20 and a die representative of a desired shape for the contact surface 44. In one embodiment, the lid 16 can be formed with a domed shape and the flexible film 20 can be thermoformed to match the domed shape of the lid, as shown in FIG. 4*b*.

Screen printing of the flexible film 20 can allow for customized styling of the key fob 10 for different vehicles, but for use with the same housing 12, PCB 14, and lid 16. In some embodiments, another flexible film can be coupled to the underside of the housing 12 to add additional stylized graphics and/or textures to the key fob 10.

The number of switches 18 in each key fob 10 can vary. However, in some embodiments, the number of apertures 42 in the lid 16 can be the same for each key fob 10. For example, the lid 16 can include enough apertures 42 for the maximum number of functions that can be controlled for any make in a family of vehicles. However, the number of switches 18 and contact surfaces 44 can be the same as or less than the number of apertures 42 in the lid. For a vehicle make, the desired number of switches 18 can be soldered to the PCB 14 in the desired locations. When the flexible film 20 is screen printed, a contact surface 44 can be printed to be positioned over each switch 18 on the PCB 14. The flexible film 20 can be pressed and flexed over the apertures 42 that do not include a switch 18, but the flexible film 20 can be sufficiently resilient to spring back without a switch 18 forcing it back. If desired, the lid 16 can be redesigned at minimal cost to eliminate the apertures 42 in the lid 16 where a switch 18 is not needed.

FIGS. 4*a*, 4*b*, and 5 illustrate cross-sections of the key fob 10. The key fob 10 can be assembled almost entirely in a single position, meaning that the components do not need to be turned over until the end of the assembly, which speeds the process and lowers costs. The PCB 14 (which can include the necessary electronic components and required number of switches 18 for the particular vehicle model) can be placed into the housing 12 so that the PCB 14 rests on the standoffs 36 in the housing 12. The lid 16 can be placed on top of the PCB 14. Depending on the manufacturing process chosen for the lid 16, the lid 16 can be separate from the flexible film 20 or already joined to the flexible film 20 by injection molding. If the flexible film 20 is not already joined to the lid 16, the flexible film 20 can be placed on top of the lid 16 and joined to the lid 16 by adhesive, laser welding, sonic welding, or by another suitable method in order to form a watertight seal between the lid 16 and the flexible film 20.

In one embodiment, laser welding can be used to join the lid 16 to the housing 12. A portion of the flexible film 20 and the lid 16 can be constructed of a material that transmits energy from the laser, while a portion of the housing 12 can be constructed of a material that absorbs energy from the laser. As shown in FIGS. 4*a* and 4*b*, the laser beam can be transmitted through the flexible film 20 and the lid 16 and absorbed by the housing 12 at a point 46 in order to heat the shelf 38 of the housing 12 to its melting point. This can cause the shelf 38 of the housing 12 to bond to the lid 16 and, in one embodiment, to the flexible film 20. If laser welding is used, a transparent region can be left around the perimeter of the flexible film 20 through which energy can be transmitted from the laser. In one embodiment, the flexible film 20 can be made from a clear material and the lid 16 can be made from an opaque white material, both of which can transmit energy from the laser, while the housing 12 can be made from a material that is substantially black that absorbs energy from the laser. In other embodiments, the housing 12 can be joined to the lid 16 and the flexible film 20 with an adhesive, by sonic welding, or by another suitable method capable of forming a watertight seal between the housing 12, the lid 16, and the flexible film 20.

After most of the components have been assembled, the key fob 10 can be turned over to install the battery 26 and the removable battery access door 28. The battery access door 28 can snap into the housing 12 and can be sealed against the housing 12 with an o-ring 48 in the cylindrical aperture 24. In some embodiments, the cylindrical aperture 24 and the o-ring 48 can be used in all the key fobs 10 for a line of vehicles, and the battery access door 28 can have any one of a variety of shapes (e.g., square, round, covering the entire back of the key fob 10, irregular shapes, etc.) for each vehicle make. The battery access door 28 can also include, for example, a mirror, a company logo, or other stylized graphics for a particular vehicle make. In some embodiments, screen printed film can be coupled to the battery access door 28 to provide the stylized graphics or the company logo.

Figure 6:
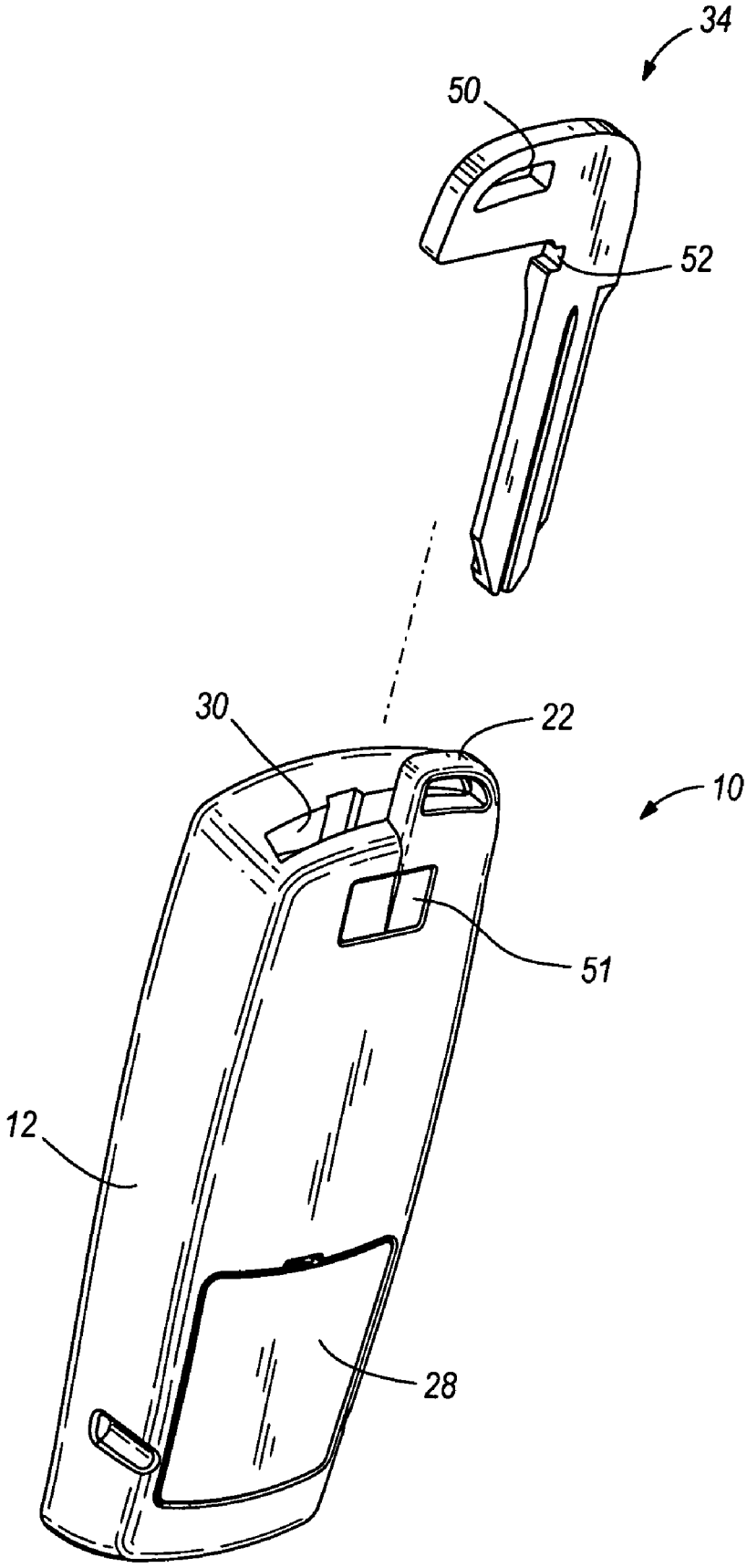
FIG. 6 is a perspective view of the key fob of FIG. 1, illustrating a removable mechanical key blade.

FIG. 6 illustrates the mechanical key blade 34 that can be stored in the housing 12. The mechanical key blade 34 can be used to manually operate the door locks, ignition, trunk, etc. The mechanical key blade 34 can include a relatively small head with an aperture 50 for attaching the mechanical key 34 blade to a key ring, etc. As shown in FIG. 2, the mechanical key blade 34 can slide into the elongated aperture 30 in the housing 12 and can be held in place by a release button 51 on the housing 12 that can engage a recess 52 on the mechanical key blade 34. The release button includes a protrusion 53 that engages the recess 52. A spring 55 biases the release button 51 toward a position wherein the mechanical key blade 34 is retained within the housing 12. The mechanical key blade 34 can be released by depressing the release button 51, which disengages the protrusion 53 from the recess 52. In some embodiments, when the mechanical key blade 34 is inserted into the elongated aperture 30, the head can cover the valet hook 22. When the mechanical key blade 34 is removed from the housing 12, the valet hook 22 can be exposed, allowing the key fob 10 to be hung up. In some embodiments, the mechanical key blade 34 can be held in the elongated aperture 30 tightly enough by the release button 51 that the key fob 10 can be carried on a key ring via the aperture 50 in the head. This arrangement allows the operator to detach the key fob 10 from the mechanical key blade 34, which can remain on the operator's key ring, in order to provide only the key fob 10 to a valet. In one embodiment, the key fob 10 can be used to actuate the vehicle's ignition, but not to open the vehicle's trunk. This is particularly useful if the operator wishes to have the car parked by a valet. The valet can use the key fob 10 to unlock the doors, drive, park, and lock the doors, but the valet cannot access the trunk. Numerous other scenarios may arise in which the operator wishes to detach the key fob 10 for vehicle use, but retain the mechanical key blade 34.

Figure 7:
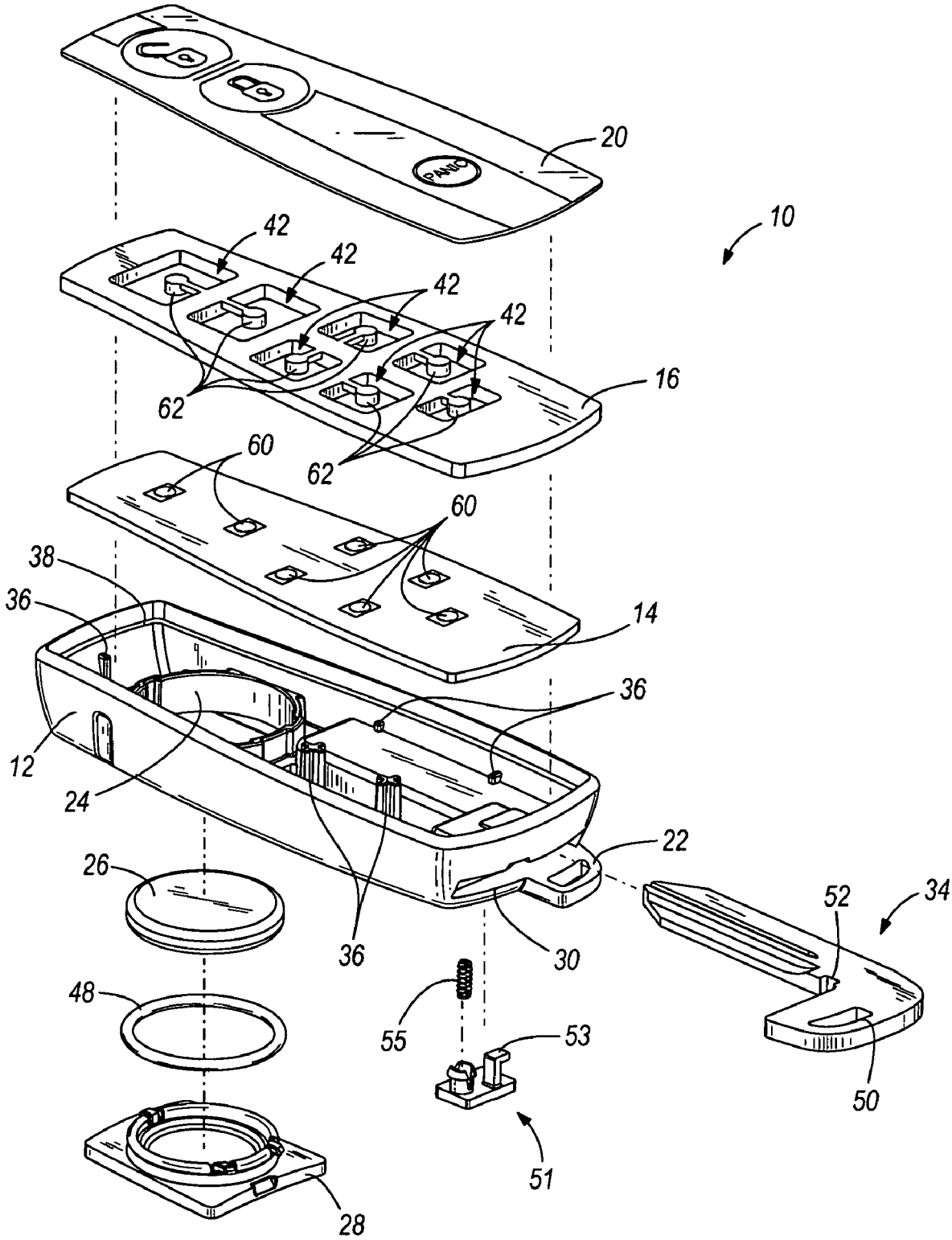
FIG. 7 is an exploded perspective view of the key fob of an alternative embodiment of FIG. 1.

FIG. 7 illustrates the key fob 10 in an alternative embodiment. The embodiment of FIG. 7 is substantially identical to the embodiment of FIGS. 1-6, but includes dome switches 60 rather than the tact switches 18 of FIGS. 1-6. The dome switches 60 can have a much lower profile than the tact switches 18, and thus can require actuators 62 positioned within the apertures 42 of the lid 16 to be actuated. When an operator applies force to a contact surface 44, the flexible film 20 transfers the force to the actuator 62. The actuator 62 is flexible, and will bend enough to actuate the dome switch 60. The actuators 62 are biased away from the dome switches 60, such that when an operator removes the force applied to the contact surface 44, the actuator 62 will retract from the dome switch 60. In the illustrated embodiment of FIG. 7, an actuator 62 can be positioned in every aperture 42 of the lid 16. Similar to the tact switches 18 mentioned earlier, the number of dome switches 60 can vary between key fobs 10. To reduce costs associated with manufacturing key fobs 10, actuators 62 can be positioned in each aperture 42 of the lid 16 whether or not a dome switch 60 is positioned within the aperture 42. This means that only one lid 16 needs to be manufactured for any key fob 10, regardless of the number of dome switches 60 that are included in the key fob 10. If dome switches 60 and actuators 62 are used in conjunction with a dome-shaped lid 16 (as in FIG. 4*b*, for example), longer actuators 62 can be used to ensure that the actuator 62 flexes to engage the dome switch 60, which is generally centered in the aperture 42.

Thus, the invention provides, among other things, a key fob that can be customized with a varying number of switches, colors, patterns, textures, and other stylized graphics, while using a housing produced by one set of tooling. A group of vehicles of different makes, models, and editions can use the same key fob components by printing different graphics, textures, etc. on the flexible film, which can provide a significant cost savings. In addition, the PCB can be provided with a varying number of switches to accommodate different features and/or numbers of features between the makes and models of the vehicles, allowing further customization of the key fob, while incurring minimal cost. Embodiments of the invention can be used in key fob designs incorporating a fixed or integrated mechanical key blade, a flip-out style mechanical key blade, and a key fob lacking a mechanical key blade. Various features and advantages of the invention are set forth in the following claims.

The invention claimed is:

1. A key fob comprising:

a housing;

a lid defining at least one aperture;

a circuit board including at least one switch positioned within the at least one aperture; and a flexible film coupled to at least one of the housing and the lid, the flexible film defining an exterior surface of the key fob, the exterior surface including at least one contact surface and a surface conterminous with the at least one contact surface, the at least one contact surface flexing when a force is applied in order to actuate the at least one switch, wherein the lid includes a first number of apertures greater than a second number of contact surfaces and switches and wherein the flexible film flexes within at least a portion of each of the first number of apertures.

2. The key fob of claim 1, wherein at least one of the flexible film and the lid is coupled to the housing with a laser weld.

3. The key fob of claim 1, wherein the housing includes a hook and an elongated aperture, and wherein a mechanical key blade at least partially conceals the hook when inserted into the elongated aperture.

4. The key fob of claim 1, wherein the housing includes a removable battery access door.

5. The key fob of claim 4, wherein the battery access door is sealed to the housing with an o-ring.

6. The key fob of claim 1, wherein the flexible film includes silk screen-printed stylized graphics.

7. The key fob of claim 1, wherein the at least one switch includes at least one of a tact switch and a dome switch.

8. The key fob of claim 1, wherein at least one of the flexible film and the lid is coupled to the housing with at least one of a laser weld, a sonic weld, an adhesive, and a snap-fit connection.

9. The key fob of claim 1, wherein the lid defines up to seven apertures, the flexible film includes up to seven contact surfaces, and the circuit board includes up to seven switches.

10. The key fob of claim 1, wherein the flexible film includes stylized graphics for a particular make of vehicle.

11. The key fob of claim 1, wherein the flexible film is coupled to the lid with at least one of a laser weld, a sonic weld, an adhesive, and injection molding the lid onto the flexible film.

12. A key fob comprising:

a housing;

a lid defining a plurality of apertures;

a circuit board including at least one switch positioned in at least one of the plurality of apertures; and a flexible film coupled to at least one of the housing and the lid and defining an exterior surface of the key fob, the exterior surface including at least one contact surface and a surface conterminous to the at least one contact surface;

a first number of the at least one switch being equal to a second number of the at least one contact surface, the first number and the second number greater than a third number of the plurality of apertures and wherein the flexible film flexes within at least a portion of each of the plurality of apertures.

13. The key fob of claim 12, wherein at least one of the flexible film and the lid is coupled to the housing with a laser weld.

14. The key fob of claim 12, wherein the housing includes a hook and an elongated aperture, and wherein a mechanical key blade at least partially conceals the hook when inserted into the elongated aperture.

15. The key fob of claim 12, wherein the housing includes a removable battery access door.

16. The key fob of claim 15, wherein battery access door is sealed to the housing with an o-ring.

17. The key fob of claim 12, wherein the flexible film includes silk screen-printed stylized graphics.

18. The key fob of claim 12, wherein the at least one switch includes at least one of a tact switch and a dome switch.

19. The key fob of claim 12, wherein at least one of the flexible film and the lid is coupled to the housing with at least one of a laser weld, a sonic weld, an adhesive, and a snap-fit connection.

20. The key fob of claim 12, wherein the lid defines up to seven apertures, the flexible film includes up to seven contact surfaces, and the circuit board includes up to seven switches.

21. The key fob of claim 12, wherein the flexible film is coupled to the lid with at least one of a laser weld, a sonic weld, an adhesive, and injection molding the lid onto the flexible film.

* * * * *